US009109834B2

(12) United States Patent
Pacheco Da Cunha

(10) Patent No.: US 9,109,834 B2
(45) Date of Patent: Aug. 18, 2015

(54) HIGH PERFORMANCE GRAIN DRYER

(76) Inventor: Otalicio Pacheco Da Cunha, Sao Leopolda RS (BR)

( * ) Notice: Subject to any disclaimer, the term of this patent is extended or adjusted under 35 U.S.C. 154(b) by 1044 days.

(21) Appl. No.: 13/055,656

(22) PCT Filed: Jul. 23, 2009

(86) PCT No.: PCT/BR2009/000221
§ 371 (c)(1),
(2), (4) Date: Jan. 24, 2011

(87) PCT Pub. No.: WO2010/009526
PCT Pub. Date: Jan. 28, 2010

(65) Prior Publication Data

US 2011/0119947 A1 May 26, 2011

(30) Foreign Application Priority Data

Jul. 25, 2008 (BR) ..... 0802885

(51) Int. Cl.
*F26B 17/14* (2006.01)

(52) U.S. Cl.
CPC ..... *F26B 17/1416* (2013.01); *F26B 17/14* (2013.01); *F26B 17/1408* (2013.01); *F26B 17/1425* (2013.01)

(58) Field of Classification Search
CPC .. F26B 17/14; F26B 17/1408; F26B 17/1416; F26B 17/1425
USPC ..... 34/201, 218, 219, 224–227
See application file for complete search history.

(56) References Cited

U.S. PATENT DOCUMENTS

| | | | | |
|---|---|---|---|---|
| 1,496,473 | A | 6/1924 | Little | |
| 1,623,553 | A * | 4/1927 | Randolph | 34/389 |
| 3,955,065 | A * | 5/1976 | Chambon | 392/384 |
| 4,004,351 | A * | 1/1977 | Sanneman et al. | 34/560 |
| 4,045,882 | A * | 9/1977 | Buffington et al. | 34/171 |
| 4,502,229 | A * | 3/1985 | Kitzman | 34/574 |

(Continued)

FOREIGN PATENT DOCUMENTS

| | | | |
|---|---|---|---|
| BR | PI05051116 | A | 7/2007 |
| DE | 579302 | C | 6/1933 |
| DE | 3100614 | A1 | 11/1981 |
| FR | 822311 | A | 12/1937 |
| FR | 2646749 | A1 | 11/1990 |

*Primary Examiner* — Kenneth Rinehart
*Assistant Examiner* — Gajanan M Prabhu
(74) *Attorney, Agent, or Firm* — Zarley Law Firm, P.L.C.

(57) ABSTRACT

High performance grains dryer fed by a heat generating source through hot air stabilizers linked to the drying column and the dryer tower, which is constituted by a series of parallel ducts, between which passes the downstream vertical now of grains, unevenly set in oblique alignment and fed so that each duct that operates as hot air entry presents laterally adjacent ducts that operate as used air exit, causing the appearance of air lows crossed to the right, crossed to the left, concurrent and countercurrent, the adopted air flows varying along the drying tower, decreasing along the same, while the perimeter walls of the dryer are equipped with particles separators that generate air flow to the dryer and separate the particles expelled by the drying process, re-conducting them to the burning in the furnace through return ducts. The drying tower is assembled on a hydraulic discharge mechanism, which controls the speed of the grains inside the dryer, releasing the grains in short cycles, eliminating self-classification and providing a uniform discharge of the product, the bottom presenting windows for the reversion of the air flow at the grains discharge.

20 Claims, 9 Drawing Sheets

(56) References Cited

U.S. PATENT DOCUMENTS 4,904,847 A * 2/1990 Kosaka et al. ..... 392/384
5,651,193 A * 7/1997 Rhodes et al. ..... 34/531
7,100,301 B1 * 9/2006 Humphrey et al. ..... 34/86
8,572,863 B2 * 11/2013 Wiesmeier et al. ..... 34/225
2005/0022419 A1 * 2/2005 Valfiorani ..... 34/589

* cited by examiner

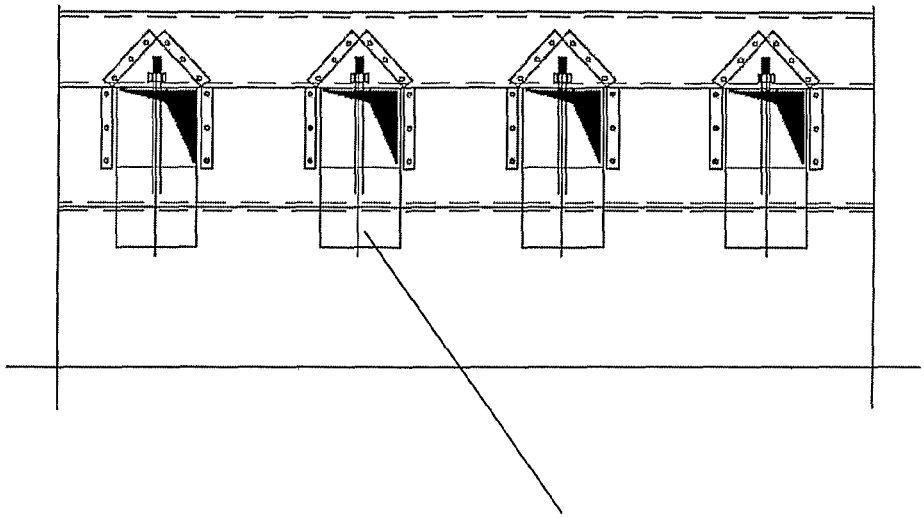
Fig.11
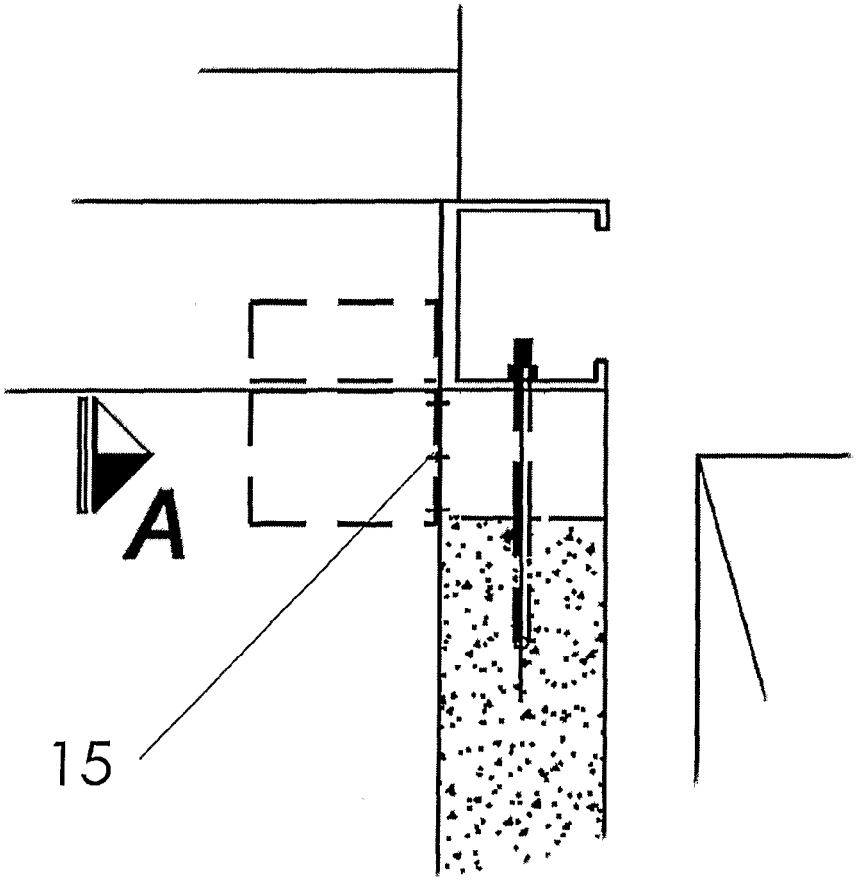

HIGH PERFORMANCE GRAIN DRYER

BACKGROUND OF THE INVENTION

The technological sector in which is inserted the present invention is the equipments sector for receiving, drying and storage of grains, and which refers, more specifically to a high performance dryer, adequate for the drying of a multiplicity of grains, such as soy beans, wheat, corn, beans, rice, sunflower grains, barley, canola, and others. This dryer conjugates in its drying tower the three air flow principles adopted in drying processes (concurrent, counter current, and crossed), besides presenting different air flow values from the top to the bottom of the tower, taking into consideration the grains' nature and their behavior during the drying in order to obtain the maximum efficiency in the process, also incorporating means for homogenization in the grains loading box, hydraulic discharge, and hot air homogenization.

The grains' drying after their harvesting and before the storage is needed due to the characteristic changes of highly hydrated products in large quantities, such as the glycides oxidation or respiration, intracellular fermentations, bacteria and fungi development, and all the resulting noxious effects.

The purpose of drying is the partial separation of a liquid (generally water), from the solid matter (grain alimentary substance), this target being reached by the water movement due to the water vapor partial pressure difference between the surface of the grains to be dried (which should be higher) and the air that involves the same (whose water vapor pressure should be lower). Water evaporates initially on the grain surface, and later the evaporation takes place inside the product. It is important to highlight that the water participates actively in the grain formation, and, therefore, it is found under different forms in this one. There are water molecules linked chemically to the components of the grain matter, which are not solvent, and which cannot be taken out by drying; however, there is also liquid water under osmotic tension, which is solvent and that retains different dissolved substances, being taken out in large part by drying (but not completely). This constitution of the grains must be considered in the drying process in order not to cause serious damage to them.

Drying can be natural, by exposing the wet product to the Sun, or can be artificial, performed in a dryer in which the product is submitted to the action of a heated air current. The heated air forced convection through the grains layer is possible because the product is granulated and not compact, and also presents a determined porosity coefficient. In this process the air performs a double role, of heat transporter fluid and of vapor transporter fluid.

The artificial drying allows to decrease rapidly the water content of agricultural products harvested wet, and avoid the undesirable alterations previously mentioned, by making use of three different techniques: drying with concurrent flow, in which the air and the product advance parallel and in the same direction in the dryer; drying with countercurrent flow, in which the air and the product advance parallel and in opposite directions, and, at last: drying with crossed flow, in which the product and the air move in perpendicular directions, principle used in the majority of grain dryers. Each of these flow types will have a different effect on the product to be dried. There are not any dryers known that combine these principles in only one equipment.

The drying performance of a grains mass crossed by a heated air current depends of the simultaneous occurrence of heat transfer to the grains, and of the water transfer from the grains to the air. The drying intensity factors increase with the air speed, and decrease with the thickness of the grains layer; in other words, they depend of the specific air flow, expressed in cubic meters of air per cubic meters of grains per time unit. The air temperature and the way how this is heated also influence the performance.

The dryer conception has direct result on the final result, and there may occur breakages and splitting of the grains after drying, or darkening phenomena of the same, in accordance with the process dynamics performed by the dryer. In particular, the last water quantities to be withdrawn from the grains to obtain the desired final humidity are the most critical, for being those of the highest demand from the energetic point of view, and the ones that could cause the greatest damage to the grains under the point of view of quality, inconvenient at the end of the drying, which can be maximized in accordance with the dryer's operation mode.

As relevant documents, for the present order, are mentioned previous deposits of the same demander, for being complementary and integrated in the screen dryer. The "hot air stabilizer", object of the patent process PI0508803-6, which executes the air volume and temperature balance between the heat source exit and the drying column and provides the uniform and efficient feeding along this one, eliminating the temperature gradients. The "solid particles separator", object of the order PI0207246-7, which generates the air for to the dryer and simultaneously makes the separation of the pellicles and particles expelled by the drying process, re-conducting them to the burning in the furnace.

SUMMARY OF THE INVENTION

The great technological evolution that took place in harvesting machines provided an accentuated increase in the speed of grains and seeds harvesting, which was not followed-up by the drying units, causing the dryers to become a critical point in the system (bottleneck), generating an urgent need to appear dryers of higher performance drying, efficiency, and speed, which are also capable to maintain the original quality of the grains after these are dry.

The present invention views characterizing a new conception of grains dryer that takes into consideration the grains nature and their behavior during the drying, viewing to obtain a superior performance to the equipments comprised by the state of technique, in what refers to the drying efficiency and the better physical final conditions of the dry grains.

These objectives will be reached through a dryer that uses all types of air flow during the grains drying process (concurrent, countercurrent, and crossed), besides varying the air flow intensity along the drying column in function of the grains behavior during the process, also foreseeing means for homogenizing the grains in the loading box, and homogenizing the hot air applied to the same (eliminating the temperature gradient) and the hydraulic discharge at the end of the process (dryer's bottom).

BRIEF DESCRIPTION OF THE DRAWINGS

So that the present invention is fully understood and taken to practice by any technician of this technological sector, the same must be explained in a clear, concise, and sufficient form to enable its reproduction, having as basis the annexed drawings listed herein below, which illustrate and subsidize.

FIG. 11: Close up view of the cross sectional drawing of the dryer, with detail in an enlarged scale of the bottom and view of the windows for air flow reversion in the grains discharge, as shown in FIG. 4.

DETAILED DESCRIPTION OF THE PREFERRED EMBOIDIMENT OF THE INVENTION

Figure 1:
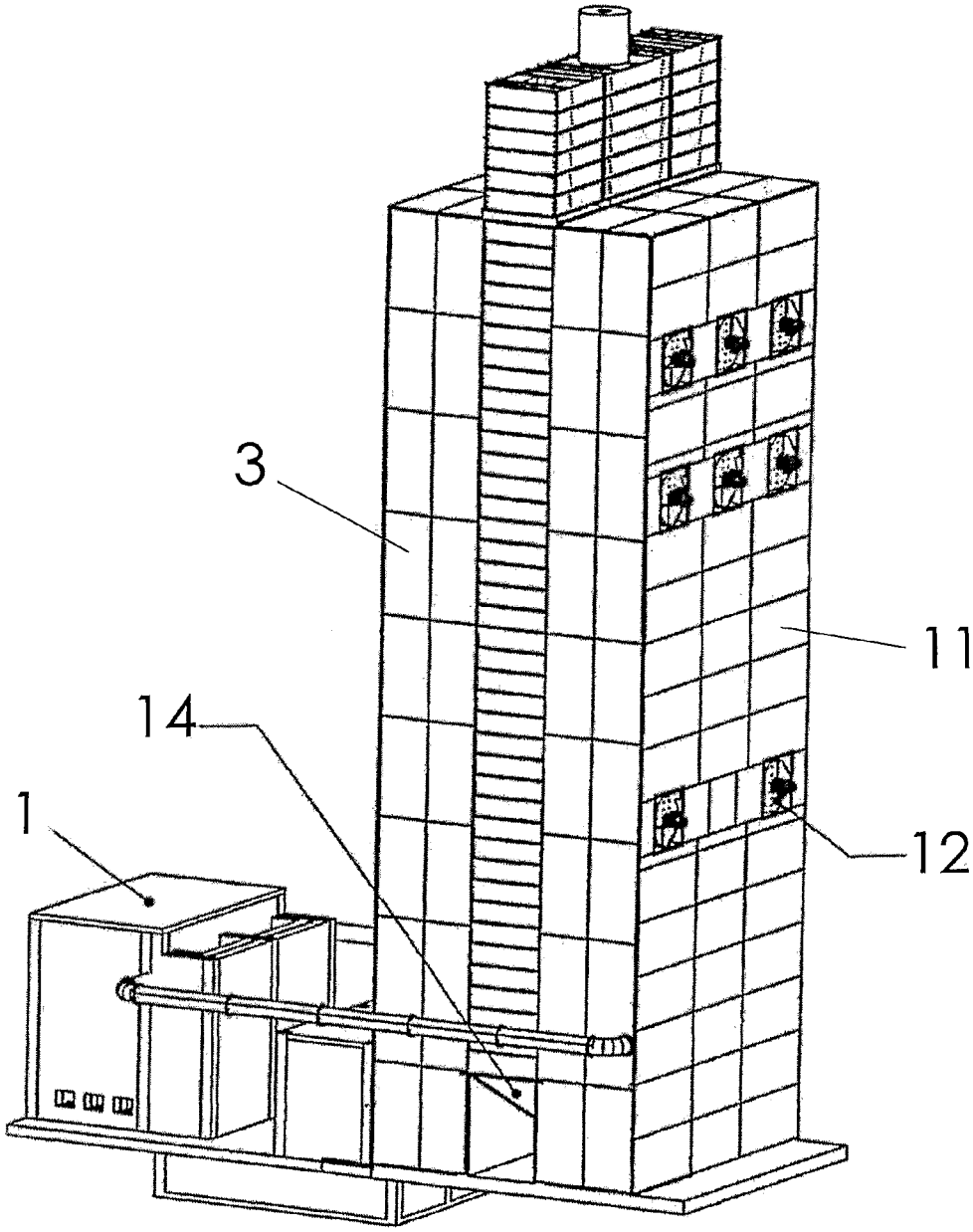
FIG. 1: Perspective drawing of the complete dryer.
Figure 2:
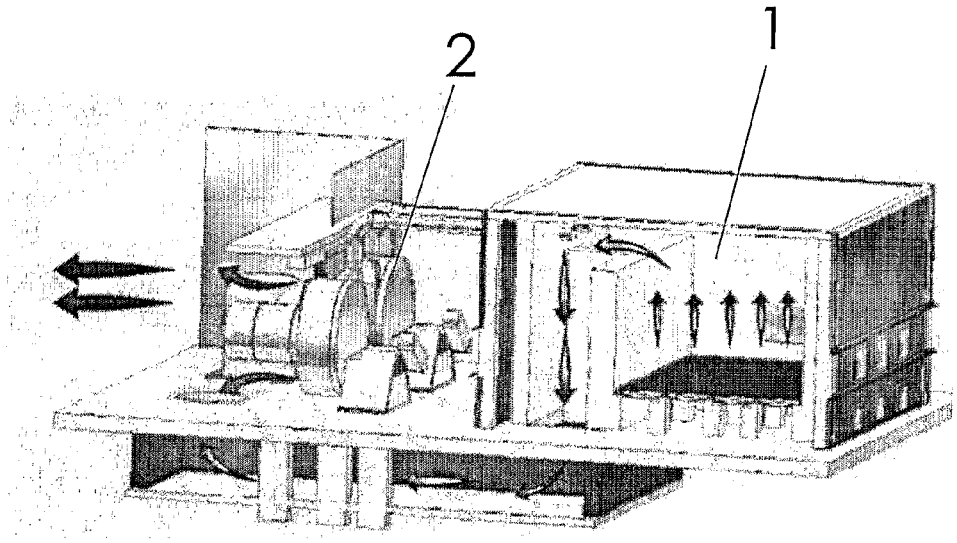
FIG. 2: Perspective drawing of the heat source detail, in case of a furnace, in which the air uniform distribution is obtained by the hot air stabilizers.
Figure 3:
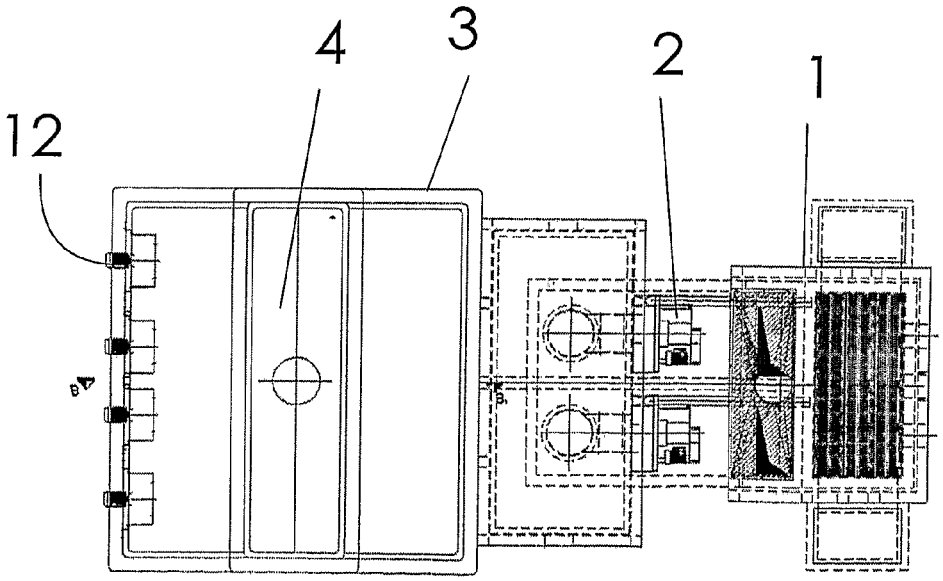
FIG. 3: upper view drawing of the dryer.
Figure 4:
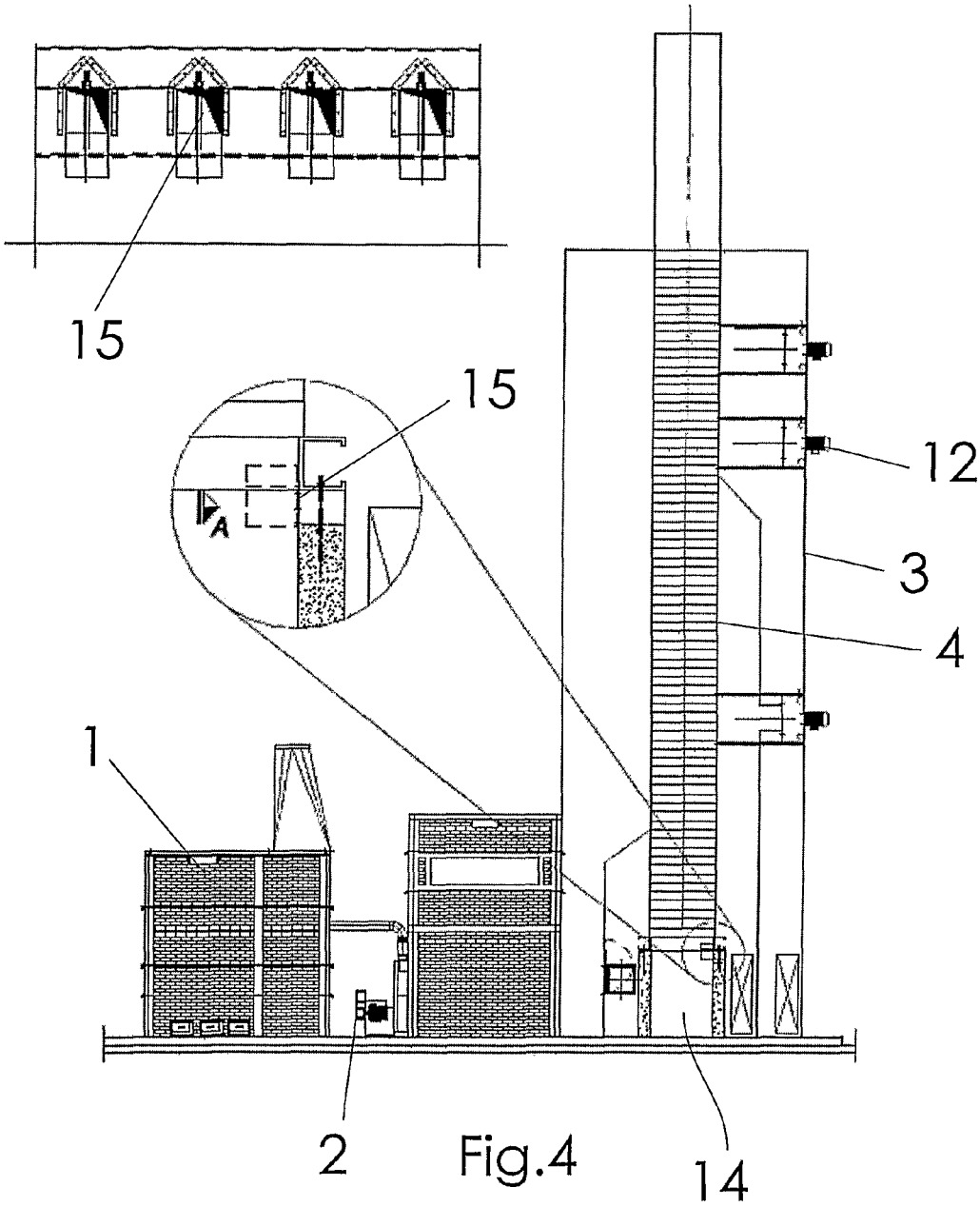
FIG. 4: Cross sectional drawing of the dryer, with detail in an enlarged scale of the bottom and view of the windows for air flow reversion in the grains discharge.
Figure 5:
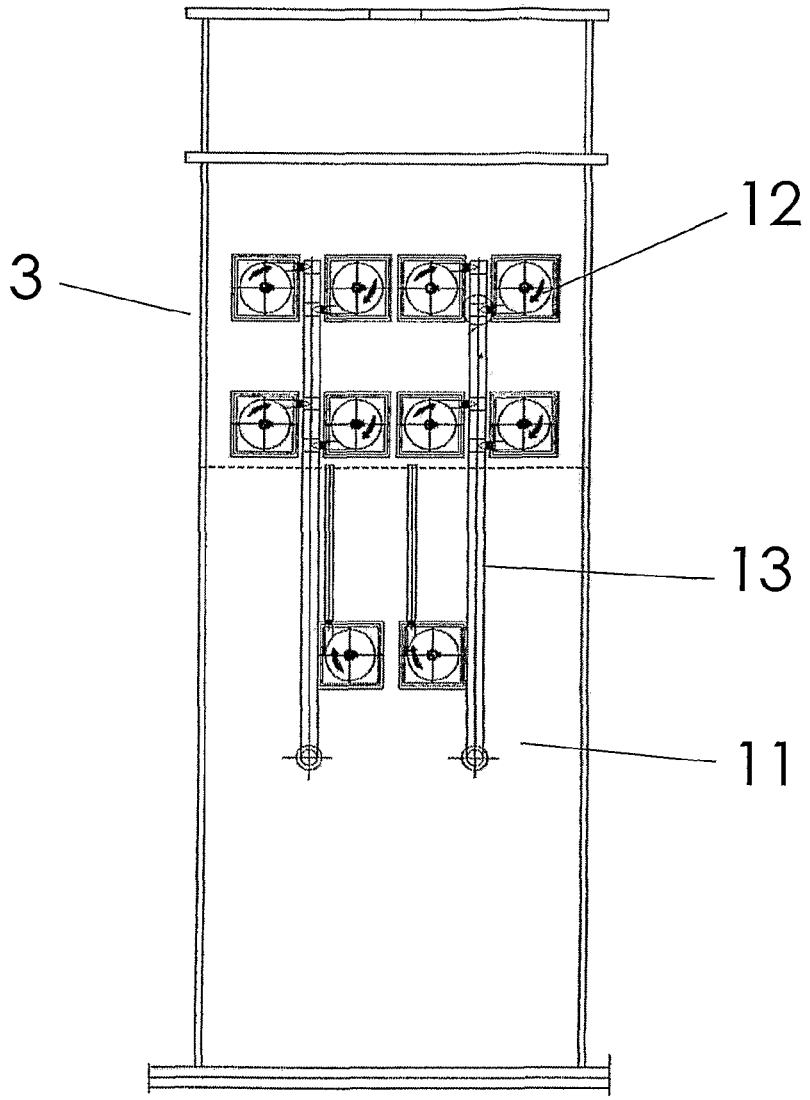
FIG. 5: Back view drawing of the dryer.
Figure 6:
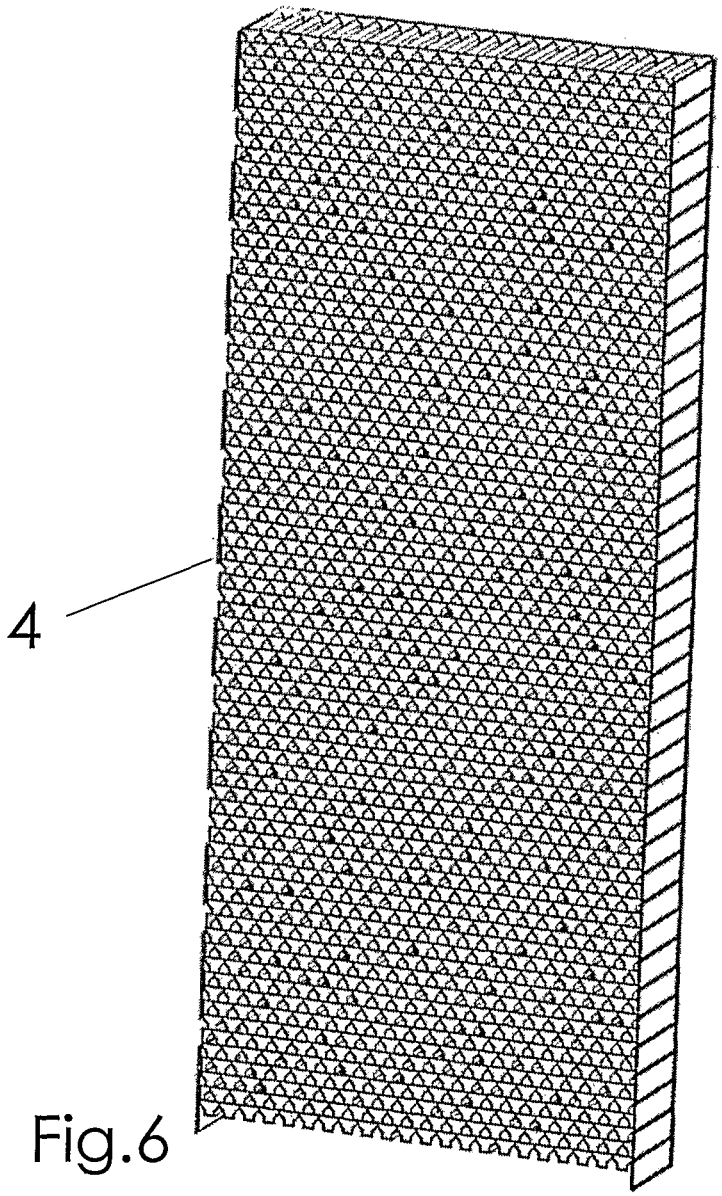
FIG. 6: Perspective drawing of the grains drying tower.
Figure 7:
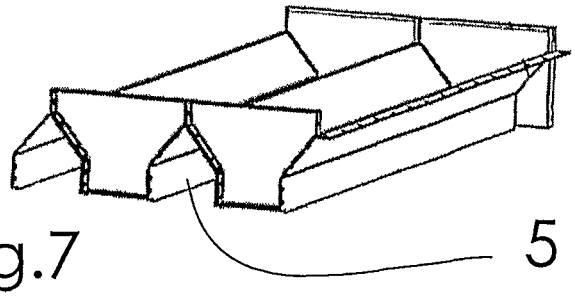
FIG. 7: Detail drawing and perspective of two ducts forming the drying tower.

Referring to FIGS. 1 to 4, we see that the high performance grains dryer, object of the present descriptive report, is fed by a heat generator source (1), as a furnace (such as the one illustrated in FIG. 2), through hot air stabilizers (2) that equalize the hot air flow supplied to the drying column (3), which shelters in its interior the drying tower (4).

The drying tower (4) is made-up by a series of parallel ducts (5), between which passes the grains vertical downstream flow, unevenly positioned in an oblique alignment and fed in a form that each duct (5) that operates as hot air entrance (E) presents ducts adjacent laterally, which operate as exit for the used air (S).

Figure 8:
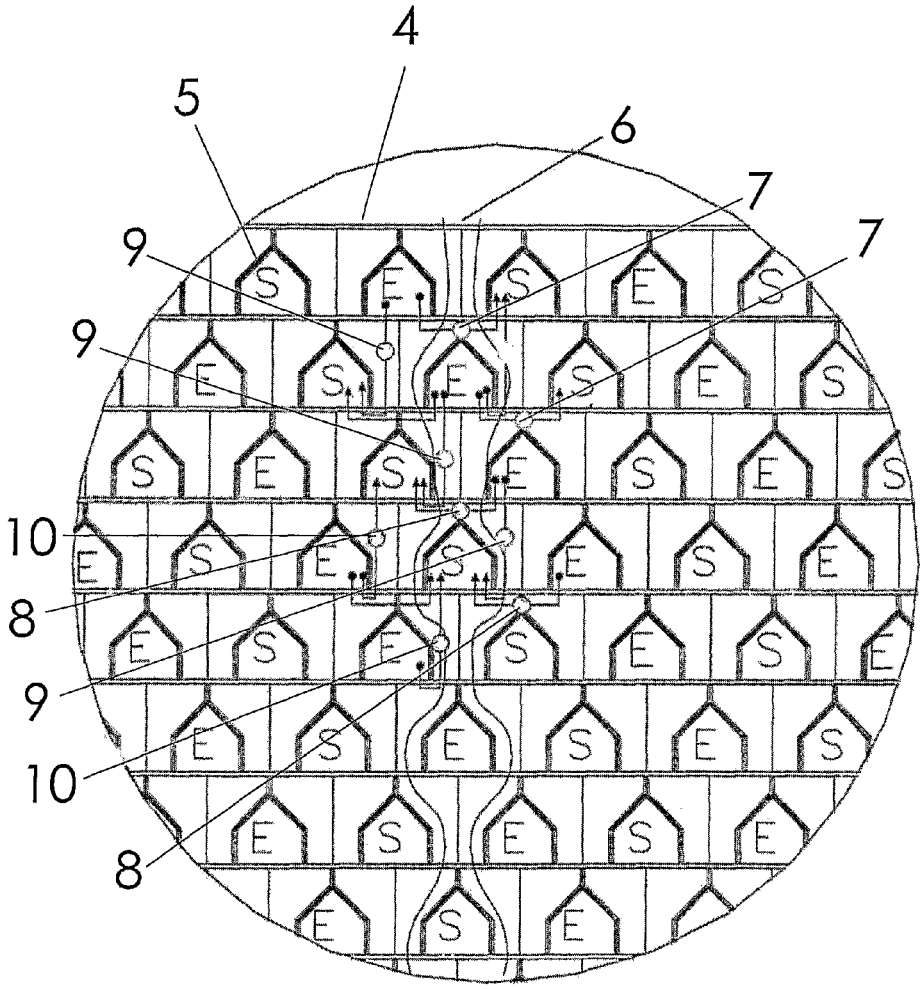
FIG. 8: Detail in enlarged scale of a portion of the drying tower illustrating the grains flow and the air flow types that take place within the same.

Referring in particular to the FIG. 8, which represents the grains flow (6) and the air flows existing in the tower (4), we verify that the air flows occur between the air entrances (E) and the air exists (S), at the same level as well as at different vertical levels, from which results that the alternate disposition of these entries (E) and exists (S) causes to appear air flows to the right and to the left between the entries (E) and the exists (S) of the same level, besides upstream and downstream vertical flows between the entries (E) and the exits (S) of different levels, generating points on which this air flow, in relation to the downstream vertical flow of the grains (6) will be crossed to the right (7), crossed to the left (8), concurrent (9), and countercurrent (10), in other words, generating all types of air flows existent for drying grains in one only drying structure.

The air flows adopted are not constant and vary along the drying tower (4), decreasing along the same, higher values being used at the top proximities, and lower values at the intermediary and inferior parts, according to the characteristics of the grains to be dried. In this way, for example, a flow of 7,500 $m^3$/h ton will be used in the first highest 25% of the tower (4), a flow of 750 $m^3$/h ton in the next 60% of the tower (4) (intermediary), and a flow of 750 $m^3$/h ton in the lowest 15%. These values are not random, being adopted according to the physical characteristics and behavior during the grains drying process.

Figure 9:
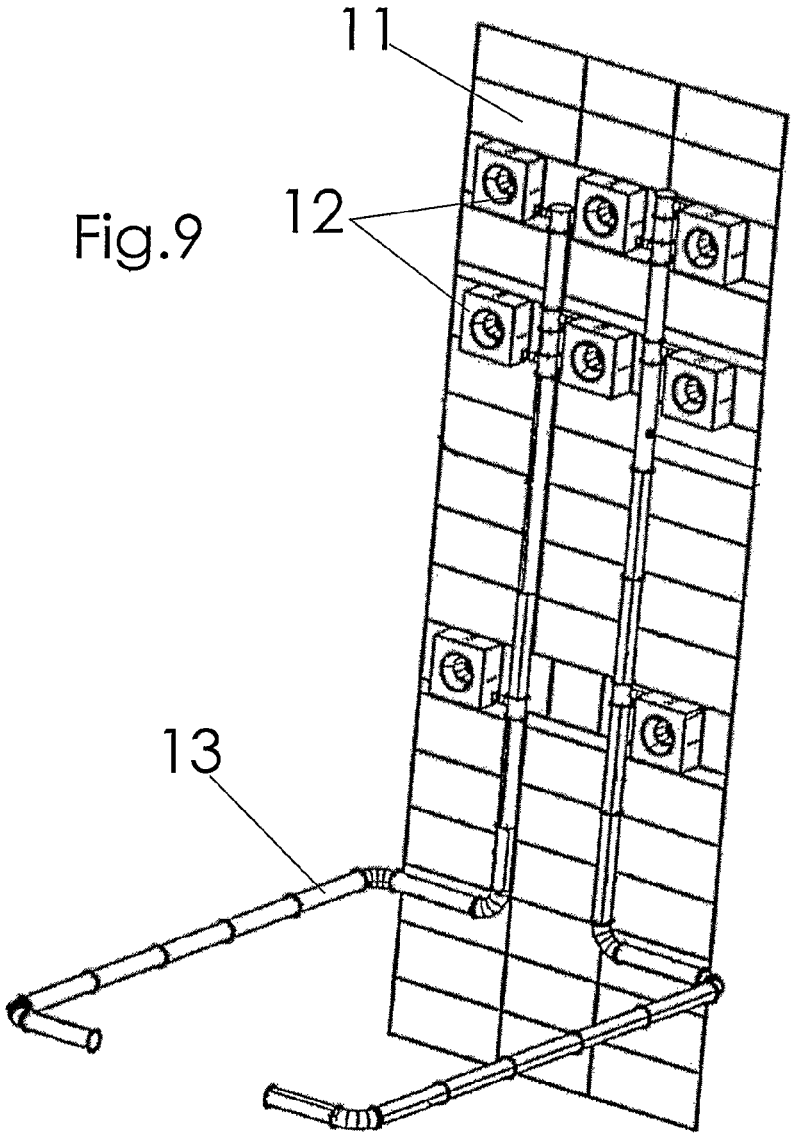
FIG. 9: Perspective drawing of one of the dryer's inner walls, where the particles separators installed in it can be seen, as well as the particles return duct to the furnace.
Figure 10:
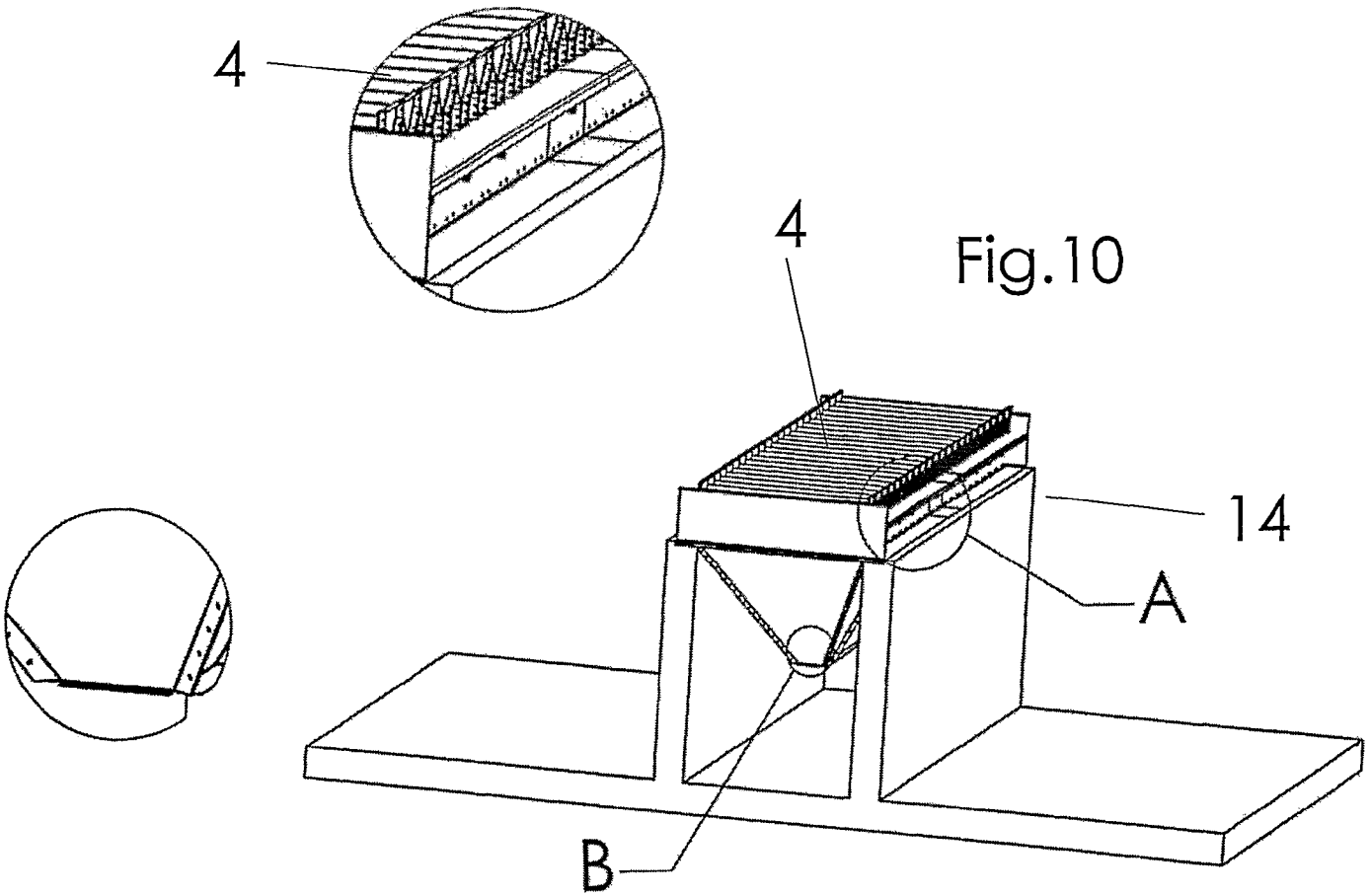
FIG. 10: Detail of the base with windows for reversion of the air flow on the grains discharge

The perimeter walls (11) of the dryer (1) are equipped with particles separators (12) (that were already object of a previous request of the present demander), which exercise double function in the dryer, generating simultaneously air flow to the dryer (1) and separating the particles expelled by the drying process, re-conducting them to the burning in the furnace through return ducts (13) (seen better in FIG. 9).

The drying tower (4) is assembled on a hydraulic discharge mechanism (14) that controls the grains' speed in the dryer, releasing the grain in short cycles, eliminating the self-classification and providing a uniform discharge of the product. On FIGS. 4 and 11 we can see the bottom with windows (15) for reversion of the air flow in the grains discharge.

The present descriptive report dealt about an invention of industrial application, with the novelty of inventive activity, being provided of all requirements determined by law to receive the requested privilege.

What is claimed:

1. A high performance grain dryer comprising:
- a drying column fed by a heat generating source;
- the drying column sheltering a drying tower positioned within the drying column;
- the drying tower having a first sidewall and a second sidewall;
- the drying tower having a plurality of ducts;
- wherein the plurality of ducts include:
  - a first end at the first sidewall that is either blocked to form a blocked end or open to form an entry end; and
  - an opposite second end at the second sidewall that is open to form an exit end if the first end is a blocked end or is blocked to form a blocked end if the first end is an open entry end;
- wherein horizontal rows are formed of a plurality of ducts positioned such that the lateral lengths of ducts are in parallel spaced alignment with one another;
- wherein ducts in a horizontal row are arranged to form a pattern of open ends that are directly next to blocked ends of adjacent ducts at the first sidewall and the second sidewall;
- wherein rows of ducts are vertically stacked within the drying tower;
- wherein the vertically stacked rows of ducts are positioned in an alternating staggered alignment such that the ducts of a row are offset from ducts of vertically adjacent rows so as to cause movement of the grain as it flows through the drying tower;
- wherein heated air flows into the open entry ends at the first sidewall, through a portion of grain within the drying tower, and flows out the open exit ends at the second sidewall thereby drying the grain in the drying tower;
- a discharge mechanism positioned at the bottom of the drying tower;
- wherein the discharge mechanism controls the speed of grain in the drying tower by releasing grain in cycles.

2. The high performance grain dryer as claimed in claim 1 wherein the heated air from the heat generating source is fed to the drying column through hot air stabilizers.

3. The high performance grain dryer as claimed in claim 1 and also characterized by air flows along the drying tower decreasing from a top end to a bottom end of the drying tower.

4. The high performance grain dryer as claimed in claim 3 and also characterized by the adoption of a more intense flow for the 25% superior parts of the drying tower and an intermediary flow for the next 60% of the drying tower, and a smaller flow for the 15% inferior parts.

5. The high performance grain dryer as claimed in claim 1 and also characterized by perimeter walls of the dryer equipped with particles separators that simultaneously generate air flow to the grain dryer and separate particles expelled by the drying process, re-conducting them to the heat generating source.

6. The high performance grain dryer as claimed in claim 1 and also characterized by airflows along the drying tower decreasing from the top to the bottom based on physical characteristics and behavior of the grain.

7. The high performance grain dryer as claimed in claim 1 wherein the grain dryer dries grain with concurrent flow, in which the air and the grain advance parallel and in the same direction in the grain dryer.

8. The high performance grain dryer as claimed in claim 1 wherein the grain dryer dries grain with counter current flow, in which the air and the grain advance parallel and in opposite directions in the grain dryer.

9. The high performance grain dryer as claimed in claim 1 wherein the grain dryer dries grain with crossed flow, in which the air and the grain advance perpendicular directions.

10. A high performance grain dryer comprising:

a drying column fed by a heat generating source;

the drying column sheltering a drying tower positioned within the in column;

the drying tower having a first sidewall and a second sidewall;

the drying tower having a plurality of ducts;

wherein the plurality of ducts include:

a first end at the first sidewall that is either blocked to form a blocked end or open to form an entry end; and an opposite second end at the second sidewall that is open to form an exit end if the first end is a blocked end or is blocked to form a blocked end if the first end is an open entry end;

wherein horizontal rows are formed of a plurality of ducts positioned such that the lateral lengths of ducts are in parallel spaced alignment with one another;

wherein ducts in a horizontal row are arranged to form a pattern of open ends that are directly next to blocked ends of adjacent ducts at the first sidewall and the second sidewall;

wherein rows of ducts are vertically stacked within the drying tower;

wherein the vertically stacked rows of ducts are positioned in an alternating staggered alignment such that the ducts of a row are offset from ducts of vertically adjacent rows so as to cause movement of the grain as it flows through the drying tower;

wherein heated air flows into the open entry ends at the first sidewall, through a portion of grain within the drying tower, and flows out the open exit ends at the second sidewall thereby drying the grain in the drying tower;

a discharge mechanism positioned at the bottom of the drying tower;

wherein the discharge mechanism controls the speed of grain in the drying tower by releasing grain in cycles;

the drying column having windows that provide the air flow reversion at a grain discharge.

11. A high performance grain dryer comprising:

a drying column fed by a heat generating source;

the drying column sheltering a drying tower positioned within the drying column;

the drying tower having a first sidewall and a second sidewall;

the drying tower having a plurality of ducts;

wherein the plurality of ducts include:

a first end at the first sidewall that is either blocked to form a blocked end or open to form an entry end; and an opposite second end at the second sidewall that is open to form an exit end if the first end is a blocked end or is blocked to form a blocked end if the first end is an open entry end;

wherein horizontal rows are formed of a plurality of ducts positioned such that the lateral lengths of ducts are in parallel spaced alignment with one another;

wherein ducts in a horizontal row are arranged to form a pattern of open ends that are directly next to blocked ends of adjacent ducts at the first sidewall and the second sidewall;

wherein rows of ducts are vertically stacked within the drying tower;

wherein the vertically stacked rows of ducts are positioned in an alternating staggered alignment such that the ducts of a row are offset from ducts of vertically adjacent rows so as to cause movement of the grain as it flows through the drying tower;

wherein heated air flows into the open entry ends at the first sidewall, through a portion of grain within the drying tower, and flows out the open exit ends at the second sidewall thereby drying the grain in the drying tower;

a discharge mechanism positioned at the bottom of the drying tower;

wherein the discharge mechanism controls the speed of grain in the drying tower by releasing grain in cycles;

the drying column having at least one window near a bottom of the drying column that provides air flow reversion.

12. The high performance grain dryer as claimed in claim 11 wherein the heated air from the heat generating source is fed to the drying column through hot air stabilizers.

13. The high performance grain dryer as claimed in claim 11 and also characterized by air flows along the drying tower decreasing from a top end to a bottom end of the drying tower.

14. The high performance grain dryer as claimed in claim 13 and also characterized by the adoption of a more intense flow for the 25% superior parts of the drying tower and an intermediary flow for the next 60% of the drying tower, and a smaller flow for the 15% inferior parts.

15. The high performance grain dryer as claimed in claim 11 and also characterized by perimeter walls of the dryer equipped with particles separators that simultaneously generate air flow to the grain dryer and separate particles expelled by the drying process, re-conducting them to the heat generating source.

16. The high performance grain dryer as claimed in claim 11 and also characterized by a bottom of the drying column having windows that provide the air flow reversion at a grain discharge.

17. The high performance grain dryer as claimed in claim 11 and also characterized by airflows along the drying tower decreasing from the top to the bottom based on physical characteristics and behavior of the grain.

18. The high performance grain dryer as claimed in claim 11 wherein the grain dryer dries grain with concurrent flow, in which the air and the grain advance parallel and in the same direction in the grain dryer.

19. The high performance grain dryer as claimed in claim 11 wherein the grain dryer dries grain with counter current flow, in which the air and the grain advance parallel and in opposite directions in the grain dryer.

20. The high performance grain dryer as claimed in claim 11 wherein the grain dryer dries grain with crossed flow, in which the air and the grain advance perpendicular directions.

* * * * *